United States Patent [19]

Moriyama et al.

[11] 4,293,002

[45] Oct. 6, 1981

[54] ELECTRICALLY OPERATED FLUID CONTROL DEVICE

[75] Inventors: Yoshiki Moriyama, Okazaki; Masayuki Kuwana, Aichi, both of Japan

[73] Assignee: Toyooki Kogyo Kabushiki Kaisha, Okazaki, Japan

[21] Appl. No.: 100,134

[22] Filed: Dec. 4, 1979

[30] Foreign Application Priority Data

Dec. 7, 1978 [JP] Japan ..... 53-151835

[51] Int. Cl.[3] ..... F15B 13/043

[52] U.S. Cl. ..... 137/625.64; 137/625.6

[58] Field of Search ..... 137/625.64, 625.6

[56] References Cited

U.S. PATENT DOCUMENTS 3,238,972 3/1966 Bowman ..... 137/625.64

3,267,965 8/1966 Kroffke ..... 137/625.64

FOREIGN PATENT DOCUMENTS 536451 6/1973 Switzerland ..... 137/625.64

1167703 10/1969 United Kingdom ..... 137/625.64

*Primary Examiner*—Gerald A. Michalsky

*Attorney, Agent, or Firm*—Stevens, Davis, Miller & Mosher

[57] ABSTRACT

An electrically operated fluid control device for controlling fluid flow under high pressure to be supplied into a fluid actuator, the control device comprising a fluid control valve assembly having a main spool to control fluid flow supplied to the fluid actuator, and an electrically operated pilot valve assembly coaxially incorporated with the control valve assembly to operate the main spool in response to an electric signal.

7 Claims, 3 Drawing Figures

ELECTRICALLY OPERATED FLUID CONTROL DEVICE

BACKGROUND OF THE INVENTION

The present invention relates to fluid control devices for controlling fluid flow under pressure, and more particularly to an electrically operated fluid control device of the type in which a main spool is operated in response to activation of an electromagnetic actuator to control fluid flow under high pressure to be supplied into a fluid actuator.

In conventional fluid control devices of this type, the operation of the main spool is piloted by the fluid under high pressure to be supplied into the fluid actuator under control of the fluid control device. For this reason, the pilot passages for the fluid under high pressure are long in length, and the construction of the control device is generally complicated and large in size. As a result, it has been experienced that the mounting place for the control device is restricted and that the response in operation of the control device is greatly influenced due to the long pilot passages.

SUMMARY OF THE INVENTION

It is, therefore, the primary object of the present invention to provide an electrically operated fluid control device wherein a pilot valve assembly is incorporated with a fluid control valve assembly in a compact construction to reduce the length of pilot passages as short as possible and wherein an electromagnetic actuator is associated with the pilot valve assembly to operate the control device in a quick response.

According to the present invention there is provided an electrically operated fluid control device for controlling fluid flow under high pressure to be supplied into a fluid actuator, the control device comprising:

a housing provided with an inlet passage for connection to a source of fluid under high pressure, an outlet passage for connection to the fluid actuator, and a drain passage for connection to a low pressure area and provided with a cylindrical bore in open communication with the respective passages at the intermediate portion thereof;

first and second pilot passages provided through the housing for communicating one end portion of the bore into the inlet passage and the drain passage respectively;

valve means including a stationary valve body disposed within the one end portion of the bore to form a fluid chamber, and a pilot spool axially slidable within the valve body and cooperating with the valve body to selectively connect the fluid chamber to the first and second pilot passages;

a main spool axially reciprocable within the intermediate portion of the bore to control the flow of fluid passing through the respective passages, the main spool being exposed at one end thereof in the fluid chamber and engageable at the other end thereof with the inner wall of the bore;

means for returning the main spool to its initial position; and an electromagnetic actuator fitted to the housing and associated with the valve means to operate the pilot spool upon energization thereof;

whereby the pilot spool is in its inoperative condition, the main spool is held in its initial position by engagement with the valve body to connect the inlet passage to the outlet passage, and when the pilot spool is operated by energization of the electromagnetic actuator, the main spool is moved due to high pressure applied into the fluid chamber to connect the outlet passage to the drain passage.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
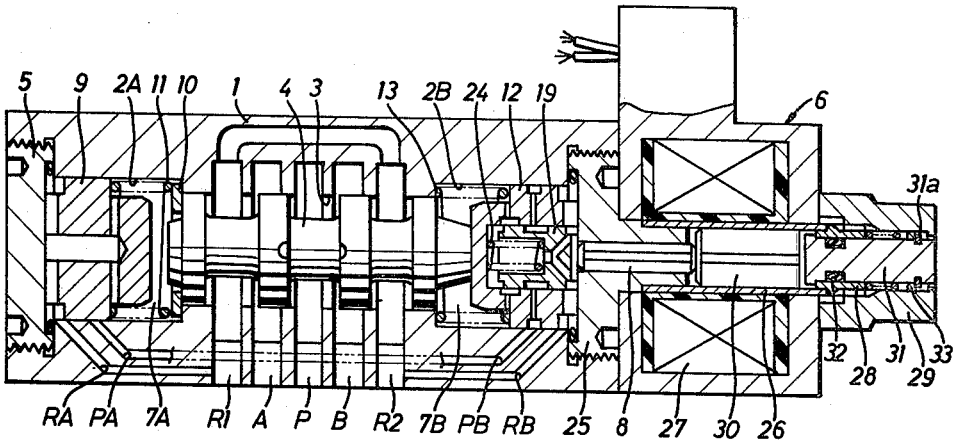
FIG. 1 is a side view of an elevational crosssection of an electrically operated fluid control device in accordance with the present invention.
Figure 2:
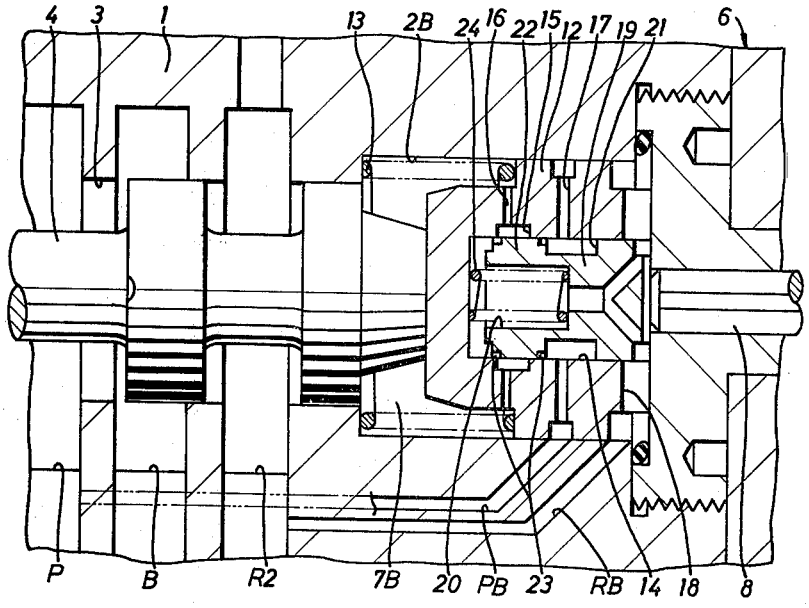
FIG. 2 is an enlarged view showing a pilot valve assembly of the control device.

Referring now to the drawing, FIG. 1 illustrates an electrically operated fluid control device in accordance with the present invention in which a pilot valve assembly is incorporated with a fluid control valve assembly and associated with an electromagnetic actuator assembly 6 to be operated by an electric control signal applied thereto. The fluid control valve assembly includes a valve housing 1 which is provided therein with a stepped cylindrical bore 3 in open communication with fluid passages P, A, B, $R_1$ and $R_2$ at the small diameter portion thereof. The fluid passage P is provided as an inlet passage for connection to a source of fluid under high pressure, each of passages A and B is provided as an outlet passage for connection to a fluid actuator (not shown), and each of passages $R_1$ and $R_2$ is provided as a drain passage for discharging fluid under pressure from the fluid actuator to a reservoir (not shown). The cylindrical bore 3 is communicated at opposite large diameter portions thereof into the inlet passage P through pilot passages PA and PB respectively and is further communicated at the same portions thereof into each of drain passages $R_1$ and $R_2$ through pilot passages RA and RB. The left hand large diameter portion 2A of bore 3 is closed in a fluid-tight manner by a plug member 5 threaded into the valve housing 1, while the right hand large diameter portion 2B of bore 3 is closed in a fluid-tight manner by the actuator assembly 6 fitted to the valve housing 1.

A main spool 4 is reciprocably disposed within the cylindrical bore 3 to control fluid flow passing through the respective fluid passages P, A, B, $R_1$ and $R_2$. A closure member 9 is disposed within the left hand large diameter portion 2A of stepped bore 3 to form a fluid chamber 7A, and a compression coil sping 11 is interposed between an annular shoulder of closure member 9 and an annular retainer 10 to bias the closure member 9 toward the plug member 5, the retainer 10 being engaged with a stepped portion of bore 3 and the left end of main spool 4. Thus, the closure member 9 forms an inner end wall of bore 3 and serves to block the pilot passage PA and to permit fluid flow from the fluid chamber 7A to the pilot passage RA therethrough.

In the pilot valve assembly, a pilot valve body 12 is disposed within the right hand large diameter portion 2B of bore 3 to form a fluid chamber 7B, and a compression coil spring 13 is interposed between a stepped portion of bore 3 and an annular shoulder of valve body 12 to bias the valve body 12 toward the actuator assembly 6. Thus, the main spool 4 is exposed at one end thereof in the fluid chamber 7A and at the other end thereof in the flulid chamber 7B and is held in position in the drawing due to abutment against the valve body 12 under resilient force of the left hand coil spring 11. The valve body 12 is provided therein with an inner bore 14 coaxial with the main spool 4 and further provided with radial passages 16, 17 and 18 communicating the inner bore 14 into the fluid chamber 7B and the pilot passages PB and RB respectively.

A pilot spool 19 is axially slidable within the inner bore 14 of valve body 12 and is biased by a compression coil spring 24 toward the actuator assembly 6. The pilot spool 19 is provided therein with a stepped inner bore 20 communicating therethrough the fluid chamber 7B to the pilot passage RB and provided thereon with an annular groove 21 co-operable with an annular groove 15 of valve body 12 to control fluid flow between radial passages 16 and 17. When the pilot spool 19 is positioned as shown in the drawing, the annular groove 15 of valve body 12 serves to connect the radial passage 16 to the inner bore 20 of spool 19 for permitting the flow of fluid from the fluid chamber 7B to the drain passage $R_2$ across pilot passage RB, and a land 22 of spool 19 serves to block the fluid under high pressure supplied from the inlet passage P across pilot passage PB. When the pilot spool 19 is moved leftward against the resilient force of spring 24, the annular groove 21 of spool 19 co-operates with the annular groove 15 of valve body 12 to provide a fluid communication between radial passages 16 and 17 for permitting the flow of fluid under high pressure into the fluid chamber 7B from the inlet passage P across pilot passage PB, and the land 22 of spool 19 interrupts the flow of fluid between the radial passage 16 and the inner bore 20 of spool 19. In addition, the land 22 of spool 19 is formed at opposite sides thereof with annular recesses 23.

The electromagnetic actuator assembly 6 includes a support member 25 threaded into the valve housing 1 in a fluid-tight manner, a tubular member 26 of non-magnetic material fitted to the outer end of support member 25 and a solenoid winding 27 wound around the tubular member 26 and coated with synthetic resin. The tubular member 26 is integrally provided with a tubular screw member 28 to which a nut member 29 is threadedly fastened in place. A push member 31 is housed within the nut member 29 and is axially slidably disposed within the screw member 28 via an annular seal member 32. The push member 31 is provided at its outer end with an annular stopper 31*a* engageable with an inner shoulder of nut member 29 and is biased by a coil spring 33 outwardly, the spring 33 being engaged at opposite ends thereof with the screw member 28 and the stopper 31*a*. Slidably disposed within the tubular member 26 is a movable core 30 of magnetic material which is in engagement with a plunger 8 axially slidable within support member 25. When the solenoid winding 27 is energized, the movable core 30 is attracted to move the plunger 8 leftward, and in turn, the pilot spool 19 is moved against resilient force of the coil spring 24 to permit the flow of fluid under high pressure into the fluid chamber 7B from the inlet passage P across pilot passage PB. Upon deenergization of the solenoid winding 27, the compressed coil spring 24 acts to return the pilot spool 19, the plunger 8 and the movable core 30 to their initial positions. In addition, the tubular member 26 is filled with fluid supplied from the pilot passage RB through radial passage 18 and the outer periphery of plunger 8. This serves to reduce undesired noises caused by movement of the core 30.

Under inoperative condition of the fluid control device described above, the pilot spool 19, the plunger 8 and the movable core 30 are held in their initial positions due to the resilient force of coil spring 24, and the main spool 4 is held in its initial position due to the resilient force of coil spring 11. Thus, the fluid under high pressure flows through inlet passage P and outlet passage B to be supplied to the fluid actuator, and the fluid from the fluid actuator is discharged into the reservoir through outlet passage A and drain passage $R_1$. In this instance, the left hand fluid chamber 7A communicates into the drain passage $R_1$ through pilot passage RA, while the right hand fluid chamber 7B communicates into the drain passage $R_2$ through radial passage 16, inner bore 20, radial passage 18 and pilot passage RB in sequence.

When the electromagnetic actuator 6 is operated by energization of the solennoid winding 27, the pilot spool 19 is moved against the resilient force of spring 24 to permit the flow of fluid under high pressure into the fluid chamber 7B across pilot passage PB. In this instance, the right hand annular recess 23 of pilot spool 19 forms an annular throttle passage to throttle the flow of fluid supplied into the fluid chamber 7B. This results in leftward movement of the main spool 4 against the resilient force of spring 11 without any impacts. Then, the fluid in the left hand fluid chamber 7A, is discharged into the drain passage $R_1$ across pilot passage RA, and the main spool 4 abuts against the closure member 9 to be positioned in its leftward stroke end. Thus, the fluid under high pressure from inlet passage P flows through outlet passage A into the fluid actuator, while the fluid from the fluid actuator is drained out into the drain passage $R_2$ through outlet passage B.

When the electromagnetic actuator 6 is deactivated upon deenergization of the solenoid winding 27, the compressed spring 24 acts to return the pilot spool 19, the plunger 8 and the movable core 30 to their initial positions. This permits the flow of fluid from the fluid chamber 7B into the drain passage $R_2$ through radial passage 16, inner bore 20, radial passage 18 and pilot passage RB. Thus, the main spool 4 is returned to its initial position due to the resilient force of spring 11 so that the fluid under high pressure from inlet passage P flows into the outlet passage B. In this instance, the fluid from the fluid actuator is drained out into the reservoir through outlet passage A and drain passage $R_1$. In addition, if the push member 31 is manually pushed inwardly against resilient force of the spring 33 during deenergization of the solenoid winding 27, the pilot spool 19 is moved to cause leftward movement of the main spool 4, as described above.

Figure 3:
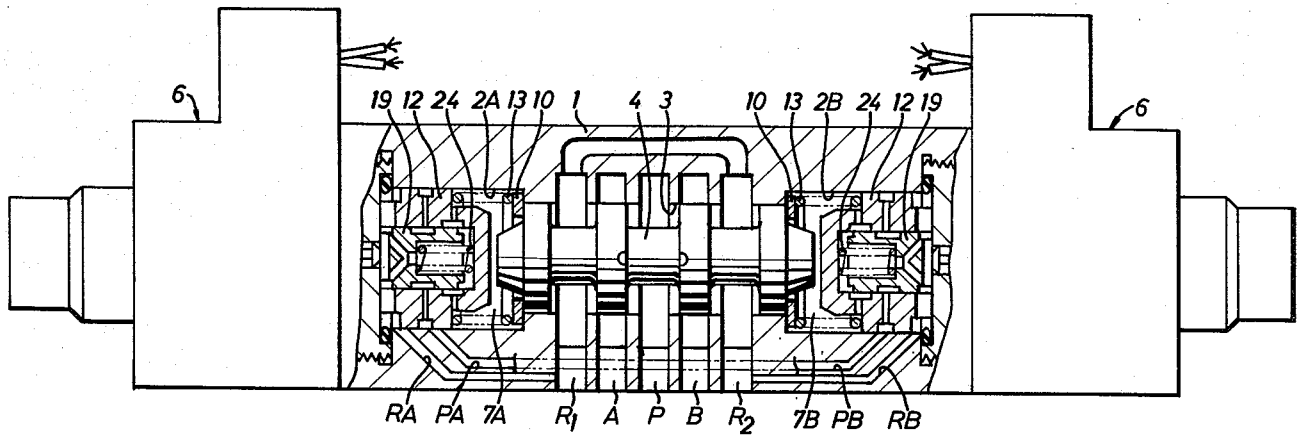
FIG. 3 is a partially broken side view of a modification of the control device.

In actual practices of the present invention, the plug member 5 and the closure member 9 may be replaced with the electromagnetic actuator 6 and the pilot valve assembly, as shown in FIG. 3. In operation of the modified fluid control device, the main spool 4 is reciprocated by alternate energization of the pair of actuators 6 to control the flow of fluid passing through the respective passages P, A, B, $R_1$ and $R_2$ to be supplied into the final actuator. If the pair of actuators 6 are erroneously energized at the same time, both the pilot spools 19 are moved inwardly to permit the flow of fluid under high pressure into the fluid chambers 7A and 7B. As a result, the main spool 4 is centered due to high pressure in the fluid chambers 7A and 7B to block the respective passages P, A, B, $R_1$ and $R_2$. This serves to eliminate erroneous operation of the fluid actuator.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. In an electrically operated fluid control device for controlling fluid flow under high pressure to be supplied into a fluid actuator, the control device comprising:

(a) a housing provided with: (i) an inlet passage for connection to a source of fluid under high pressure, (ii) an outlet passage for connection to said fluid actuator, (iii) a drain passage for connection to a low pressure area, and (iv) a cylindrical main bore, said main bore being, at the intermediate portion thereof, in open communication with each of said inlet, outlet and drain passages;

(b) first and second pilot passages provided through said housing for communicating one end portion of said main bore with said inlet and drain passages respectively;

(c) a main spool axially reciprocable within the intermediate portion of said main bore to control the flow of fluid passing through said inlet, outlet and drain passages, said main spool forming a fluid chamber at one end thereof within said end portion of said main bore;

(d) valve means disposed within said end portion of said main bore for selectively connecting said fluid chamber to said first and second pilot passages;

(e) resilient means for biasing said main spool towards said fluid chamber; and (f) an electromagnetic actuator fitted to said housing and including a movable core operatively connected with said valve means upon energization of said electromagnetic actuator; the improvement wherein said valve means comprises:

(A) a stationary pilot valve body disposed within said end portion of said main bore to defined said fluid chamber at its inner wall, said pilot valve body comprising (i) an inner bore coaxial with said main spool, and (ii) inlet, outlet and drain ports respectively communicating said inner bore with said first pilot passage, said fluid chamber, and said second pilot passages;

(B) a pilot spool axially slidable within the inner bore of said pilot valve body for selectively connecting said outlet port with said inlet and drain ports through said inner bore, said pilot spool being operatively connected to said movable core of said electromagnetic actuator; and (C) a spring disposed within the inner bore of said valve body for biasing said pilot spool toward said movable core.

2. An electrically operated fluid control device according to claim 1, wherein (a) said main bore is a stepped cylindrical bore having small and large diameter portions, the small diameter portion of said main bore being in open communication with each of said inlet, outlet and drain passages;

(b) said first and second pilot passages are arranged to communicate the large diameter portion of said main bore with said inlet and drain passages;

(c) said main spool is reciprocable within the small diameter portion of said main bore, said fluid chamber being formed by the one end of said main spool within the large diameter portion of said main bore; and (d) said pilot valve body of said valve means is disposed within the large diameter portion of said main bore to define said fluid chamber at the closed inner end wall of said body.

3. An electrically operated fluid control device according to claim 2, wherein an annular retainer is engaged with the one end of said main spool and a stepped portion of said main bore, and a spring is interposed between said annular retainer and an inner shoulder of said valve body to resiliently retain said valve body in its position and said main spool biased toward said valve body.

4. An electrically operated fluid control device as claimed in claim 2 or 3, wherein said electromagnetic actuator comprises a support member fitted to said housing, a tubular member of non-magnetic material secured to said support member coaxially with said pilot spool, a solenoid winding wound around said tubular member, a movable core axially slidable within said tubular member to be attracted toward said pilot spool upon energization of said solenoid winding, and a plunger axially slidable within said support member and being engaged at opposite ends thereof with said pilot spool and said movable core.

5. An electrically operated fluid control device as claimed in claim 4, wherein said electromagnetic actuator further comprises a push member slidable within an extended portion of said tubular member and engageable with said movable core, and resilient means for biasing said push member outwardly, said push member being arranged to be manually moved against resilient force of said resilient means to operate said pilot spool.

6. An electrically operated fluid control device for controlling fluid flow under high pressure to be supplied into a fluid actuator, the control device comprising:

(a) a housing provided with an inlet passage for connection to a source of fluid under high pressure, a pair of outlet passages for connection to said fluid actuator, and a pair of drain passages for connection to a fluid reservoir and provided with a stepped cylindrical main bore having a pair of large diameter portions and a small diameter portion between the large diameter portions, said main bore, at its small diameter portion, being in open communication with said inlet, outlet and drain passages;

(b) a pair of first pilot passages provided through said housing for communicating said inlet passage with each of large diameter portions of said main bore;

(c) a pair of second pilot passages provided through said housing for communicating each of said drain passages with the respective large diameter portions of said main bore;

(d) a main spool axially reciprocable within the small diameter portion of said main bore to control the flow of fluid passing through said inlet, outlet and drain passages, said main spool forming a pair of fluid chambers at the opposite ends thereof respectively within the large diameter portions of said main bore;

(e) a pair of valve means respectively disposed within the large diameter portions of said bore for selectively connecting each of said fluid chambers to each of said first pilot passages and each of said second pilot passages; and (f) a pair of electromagnetic actuators fitted to said housing at the opposite ends of said main bore and respectively including a movable core operatively connected with each of said valve means for operating said respective valve means upon energization thereof; and wherein each of said valve means further comprises: (i) a stationary valve body disposed within each of the large diameter portions of said bore to define said respective fluid chambers at its inner wall, said valve body being formed with an inner bore coaxial with said main spool, (ii) inlet, outlet and drain ports respectively communicating said inner bore with said respective first pilot passages, fluid chambers and second pilot passages, (iii) a pilot spool axially slidable within said inner bore of said valve body for selectively connecting said outlet port with said inlet and drain ports through said inner bore, said pilot spool being operatively connected with each of said movable cores of said actuators, and (iv) a spring disposed within said inner bore of said valve body for biasing each of said pilot spools toward the corresponding movable core.

7. An electrically operated fluid control device as claimed in claim 6, further comprising a pair of annular retainers engaged with the opposite ends of said main spool and opposite stepped portions of said main bore, and a pair of springs interposed between each of said retainers and the corresponding inner shoulder of each of said valve bodies to resiliently retain said main spool in its neutral position.

* * * * *